US007304275B2

(12) United States Patent
Chun et al.

(10) Patent No.: US 7,304,275 B2
(45) Date of Patent: Dec. 4, 2007

(54) COOKING APPARATUS, COOKING SYSTEM, AND COOKING CONTROL METHOD UTILIZING BAR CODE

(75) Inventors: Yun Bong Chun, Yongin-Si (KR); Kwang Keun Kim, Yongin-Si (KR); Sook Young Ji, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/360,610

(22) Filed: Feb. 24, 2006

(65) Prior Publication Data

US 2007/0007279 A1 Jan. 11, 2007

(30) Foreign Application Priority Data

Jul. 6, 2005 (KR) ..... 10-2005-0060827

(51) Int. Cl.
*H05B 1/02* (2006.01)

(52) U.S. Cl. ..... 219/506; 219/497; 219/714; 99/325

(58) Field of Classification Search ..... 219/506, 219/704, 714, 483–486, 497, 490, 518, 519, 219/412–414; 99/325–333
See application file for complete search history.

(56) References Cited

U.S. PATENT DOCUMENTS

| | | | | |
|---|---|---|---|---|
| 5,361,681 | A * | 11/1994 | Hedstrom et al. | 99/331 |
| 5,377,582 | A * | 1/1995 | Nersesian | 99/420 |
| 6,009,400 | A * | 12/1999 | Blackman | 705/1 |
| 2002/0027164 | A1* | 3/2002 | Mault et al. | 235/462.46 |
| 2003/0014323 | A1* | 1/2003 | Scheer | 705/26 |

FOREIGN PATENT DOCUMENTS

| | | |
|---|---|---|
| JP | 61-114018 | 5/1986 |

* cited by examiner

*Primary Examiner*—Mark Paschall
(74) *Attorney, Agent, or Firm*—Staas & Halsey LLP

(57) ABSTRACT

A cooking apparatus, cooking system, and cooking control method using a bar code, in which automatic cooking of food is performed when the bar code attached to a package of the food is lost or damaged. The cooking apparatus for cooking food using cooking data includes a memory for storing identification data and cooking data of the food; an image capture device for obtaining an image of the food; and a controller for identifying the food by comparing the image of the food to the identification data of the food, stored in the memory, obtaining the cooking data of the identified food, and controlling the cooking apparatus so that the cooking of the food is performed based on the cooking data.

1 Claim, 13 Drawing Sheets

COOKING APPARATUS, COOKING SYSTEM, AND COOKING CONTROL METHOD UTILIZING BAR CODE

CROSS-REFERENCE TO RELATED APPLICATIONS

This application claims the benefit of Korean Patent Application No. 2005-60827, filed Jul. 6, 2005, in the Korean Intellectual Property Office, the disclosure of which is incorporated herein by reference.

BACKGROUND OF THE INVENTION

1. Field of the Invention

The present invention relates to a cooking apparatus, cooking system, and cooking control method using a bar code, and more particularly, to a cooking apparatus, cooking system, and cooking control method, in which food without a bar code attached thereto is automatically cooked.

2. Description of the Related Art

Generally, cooking apparatuses cook food using a variety of heat sources. There is a great variety of cooking apparatuses that have different heat sources on the market. A microwave oven is a cooking apparatus using microwaves as a heat source. The conventional microwave oven allows a user to directly input a cooking time, a cooking method, and an object to be cooked through a key input unit formed on a front panel of the microwave oven. Since the user manually inputs cooking data, the above conventional microwave oven is disadvantageous in that it is difficult to set proper cooking conditions and inconvenient to the user to input the complex data.

In order to solve the problems described above, a microwave oven has been developed with a bar code reader so that food is cooked according to the cooking data read by the bar code reader. That is, an internal bar code reader is installed in the microwave oven, or an external bar code reader is connected to the microwave oven. The bar code reader reads a bar code of the food and transmits cooking data of the food to a controller of the microwave oven, and the controller controls the output level and the heating time of a magnetron according to the cooking data so that the cooking of the food is carried out.

Such a microwave oven that uses the bar code cannot cook a food product without a bar code or a food product that has a damaged bar code attached to a package thereof.

SUMMARY OF THE INVENTION

Additional aspects and/or advantages of the invention will be set forth in part in the description which follows and, in part, will be apparent from the description, or may be learned by practice of the invention.

Therefore, one aspect of the invention is to provide a cooking apparatus, cooking system, cooking control method, in which food with a damaged bar code or without a bar code is appropriately cooked.

In accordance with a first aspect, the present invention provides a cooking apparatus for cooking food using cooking data, including: a memory for storing identification data ("ID") and cooking data of the food; an image capture device for obtaining an image of the food; and a controller for identifying the food by comparing the image of the food to the identification data of the food, stored in the memory, obtaining the cooking data of the identified food, and controlling the cooking apparatus so that the cooking of the food is performed based on the obtained cooking data.

The cooking apparatus may further include a bar code reader for obtaining the cooking data of the food by reading a bar code of the food, wherein the controller obtains the cooking data by capturing the image of the food using the image capture device when the bar code reader cannot read the bar code of the food or the user decides to use the image capture device instead of the bar code reader.

In accordance with a second aspect, the present invention provides a cooking system for cooking food using cooking data, including: a data processing unit for obtaining the cooking data of the food from a memory provided therein or a web server connected thereto on-line; and a cooking apparatus for receiving the cooking data obtained by the data processing unit and cooking the food based on the cooking data.

The data processing unit may be any device capable of storing data such as a PC, a PDA, and a web pad of a refrigerator.

In accordance with a third aspect, the present invention provides a cooking system for cooking food using cooking data including: an image capture device for capturing an image of the food; a data processing unit for identifying the food using the resulting image and obtaining the cooking data of the identified food; and a cooking apparatus for cooking the food based on the obtained cooking data.

The data processing unit may be one of a PC, a PDA, and a web pad of a refrigerator, and obtain the cooking data of the food from a memory provided therein or a web server connected thereto on-line.

The image capture device may be a PC camera or a digital camera, and include a wired or wireless transmission module for transmitting the image to the data processing unit.

In accordance with a fourth aspect, the present invention provides a cooking system for cooking food using cooking data including: an image capture device for capturing an image of the food; a data processing unit for identifying the food using the resulting image and obtaining an image of a bar code, in which the cooking data of the identified food is recorded; an output unit for outputting (printing) the image of the bar code; and a cooking apparatus, including a bar code reader, for obtaining the cooking data of the food by reading the outputted image of the bar code and cooking the food based on the obtained cooking data.

The data processing unit may be one of a PC, a PDA, and a web pad of a refrigerator, and obtain the cooking data of the food from a memory provided therein or a web server connected thereto on-line.

The image capture device may be a PC camera or a digital camera, and includes a wired or wireless transmission module for transmitting the image to the data processing unit.

In accordance with a fifth aspect, the present invention provides a cooking control method of a cooking apparatus for cooking food using cooking data, including: capturing an image of the food using an image capture device provided in the cooking apparatus; identifying the food by comparing the image of the food to identification data of the food, stored in a memory of the cooking apparatus, and obtaining the cooking data of the identified food; and controlling the cooking apparatus so that the cooking of the food is performed based on the obtained cooking data.

The cooking control method may further include a tool where a user selects at least one image of the food from a bar code reading mode and a food image capturing mode.

The cooking apparatus may be automatically switched into the food image capturing mode when the bar code reading mode cannot be performed.

In accordance with a sixth aspect, the present invention provides a cooking control method of a cooking system for cooking food using cooking data including: obtaining the cooking data of the food from a memory, provided in a data processing unit, or a web server, connected to the data processing unit on-line; and receiving the obtained cooking data, and performing the cooking of the food based on the cooking data.

The obtaining of the cooking data of the food may be performed using one of a PC, a PDA, and a web pad of a refrigerator.

In accordance with a seventh aspect, the present invention provides a cooking control method of a cooking system for cooking food using cooking data including: obtaining an image of the food; identifying the food by comparing the image of the food to identification data of the food, stored in a memory, installed in a cooking apparatus of the cooking system, or a web server connected to the cooking apparatus on-line, and obtaining the cooking data of the identified food; supplying the obtained cooking data to the cooking apparatus; and causing the cooking apparatus to perform the cooking of the food based on the received cooking data.

A PC camera or a digital camera may be used to obtain the image of the food.

A power line communication or a wired or wireless LAN may be used to supply the obtained cooking data to the cooking apparatus.

The resulting cooking data may be supplied to the cooking apparatus. A bar code reader of the cooking apparatus may be used to supply the resulting cooking data to the cooking apparatus by outputting the resulting cooking data in a bar code image and reading the bar code image.

A display window of the data processing unit may display the bar code image.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1A:
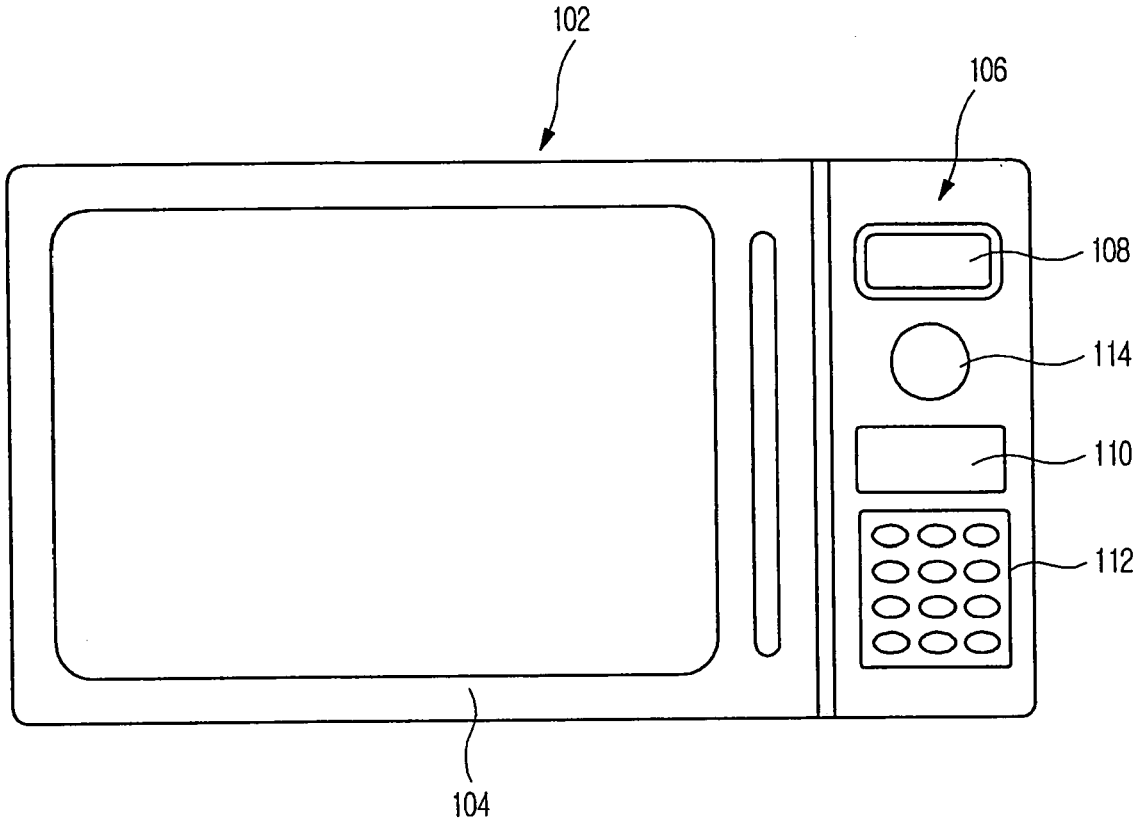
FIG. 1A is a schematic view of a microwave oven with a bar code reader and an image capture device in accordance with the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 1B:
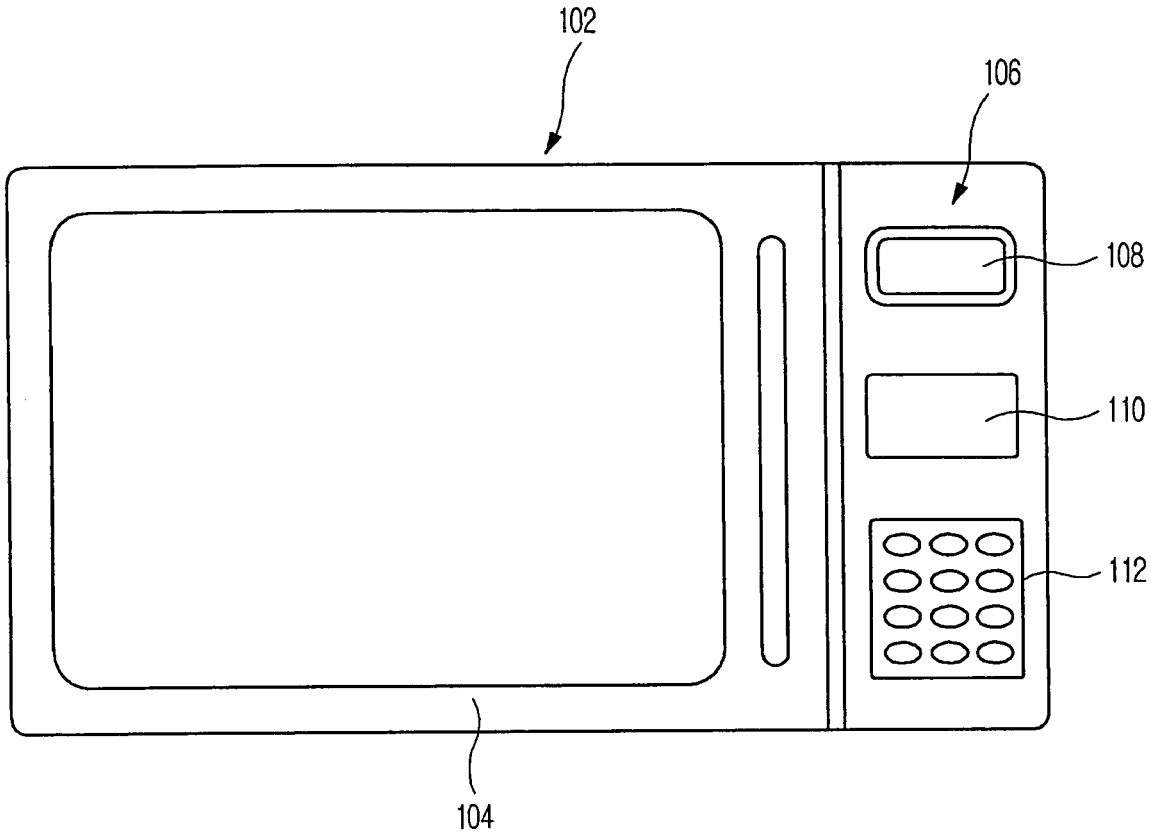
FIG. 1B is a schematic view of a microwave oven with a bar code reader and without an image capture device in accordance with the present invention.

FIG. 1A is a schematic view of a microwave oven with a bar code reader and an image capture device in accordance with the present invention, and FIG. 1B is a schematic view of a microwave oven with a bar code reader and without an image capture device in accordance with the present invention.

One microwave oven of the present invention, as shown in FIG. 1A, includes a main body 102, a door 104 provided on the front surface of the main body 102, and a front panel 106 installed on the right side of the door 104. The front panel 106 could also be positioned on another side of the door 104. An internal bar code reader 108 for reading a bar code is installed on the upper portion of the front panel 106, and an image capture device 114 for capturing an image and a display unit 110 for displaying the operating state of the microwave oven are installed on the front panel 106 below the internal bar code reader 108. A key input unit 112 having a plurality input buttons is installed on the front panel 106 below the display unit 110. The key input unit 112 has a start button for inputting a cooking start signal, a bar code reading button for reading bar code reading instructions signal, a cooking method button for setting a cooking method, a cooking time button for setting a cooking time, and a plurality of numbered buttons. Another microwave oven of the present invention, as shown in FIG. 1B, does not include an image capture device, however, the other elements of this microwave oven are the same as those of the microwave oven of FIG. 1A.

Although the microwave ovens of FIGS. 1A and 1B include the bar code reader 108 and/or the image capture device 114, a cooking apparatus (for example, a microwave oven) in accordance with the present invention, the microwave ovens may also comprise one or both of the bar code reader 108 and the image capture device 114, or neither the bar code reader 108 nor the image capture device 114.

First Embodiment

Figure 2:
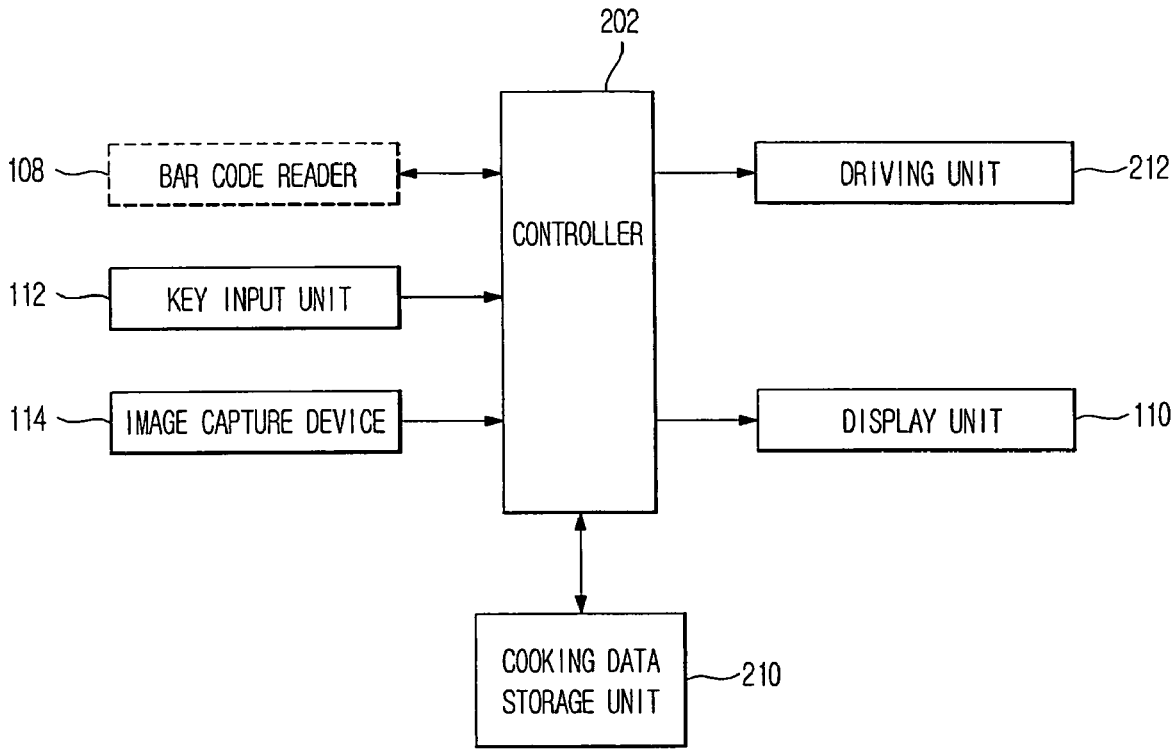
FIG. 2 is a block diagram of a microwave oven in accordance with a first embodiment of the present invention.

FIG. 2 is a block diagram of a microwave oven in accordance with a first embodiment of the present invention. As shown in FIG. 2, the key input unit 112 having a plurality of buttons for allowing a user to input control instructions and the image capture device 114 serving as an optical device for obtaining an image are connected to an input side of a controller 202 for controlling the whole operation of the microwave oven. If necessary, the bar code reader 108 is optionally connected to the input side of the controller 202.

A driving unit 12 for driving a magnetron (not shown) or a heater (not shown) for heating food to be cooked and the display unit 110 for displaying the operating state of the microwave oven are connected to an output side of the controller 202.

In accordance with the embodiment of the present invention, cooking data includes the output level and the heating time of the magnetron and the serving amount of the food so that the food is cooked in the optimum state. The controller 202 of the microwave oven controls the output level of the magnetron (or the heating temperature of the heater) and the heating time of the magnetron according to the above cooking data, thereby allowing the food to be automatically cooked.

A cooking data storage unit 210, which stores identification data of various foods (for example, image data for identifying foods) and cooking data in a database, is connected to the controller 202.

Figure 3:
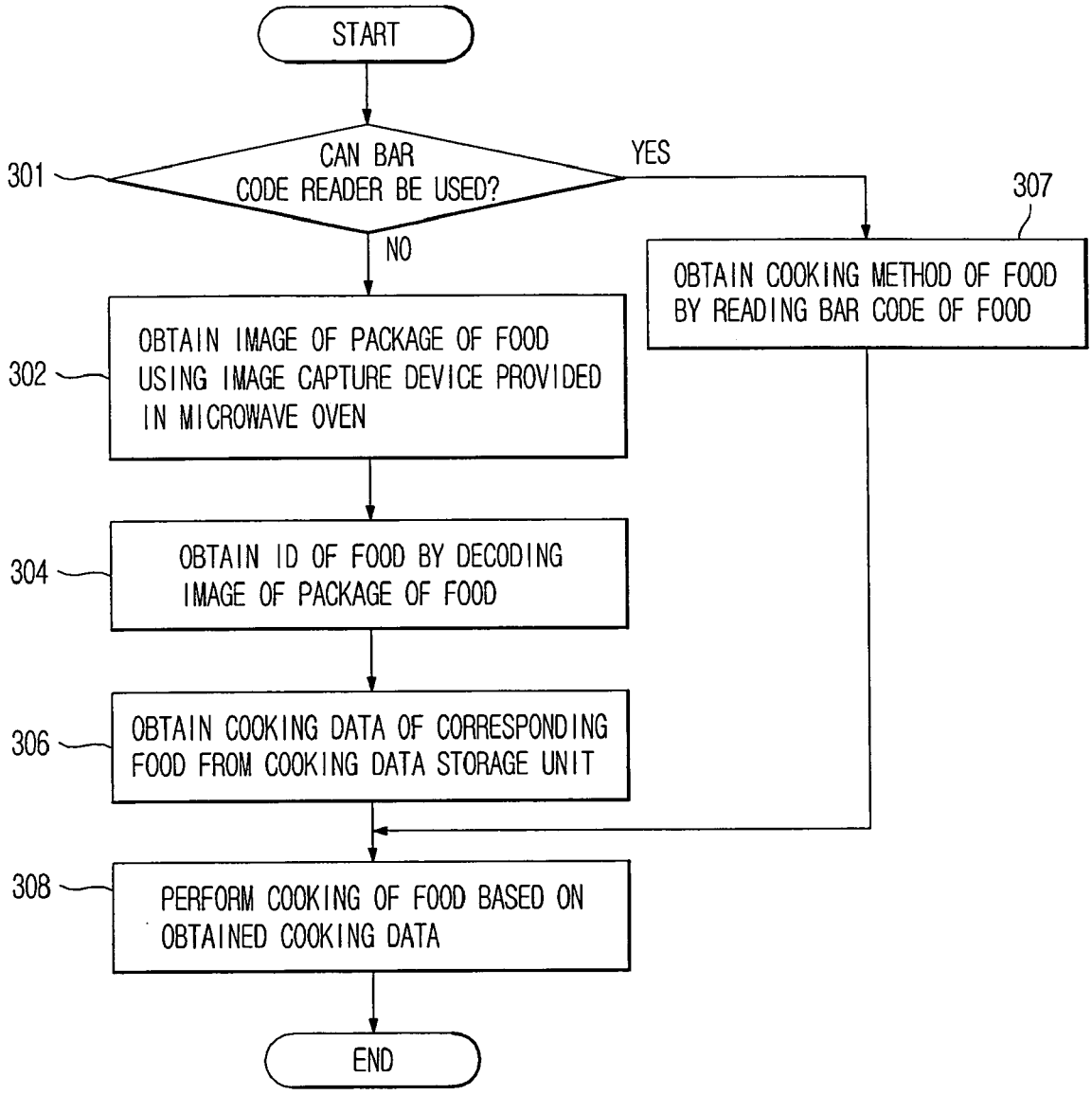
FIG. 3 is a flow chart illustrating a cooking control method in accordance with the first embodiment of the present invention, in which food is automatically cooked by obtaining cooking data of the food using an image capture device of the microwave oven, when the cooking data of the food is not obtained through a bar code.

FIG. 3 is a flow chart illustrating a cooking control method in accordance with the first embodiment of the present invention, in which food is automatically cooked according to cooking data of the food, obtained using an image capture device of the microwave oven, when the cooking data of the food are not obtained through a bar code. That is, when the bar code reader 108 of the microwave oven cannot read a bar code from the food package or the user decides to use the image capture device 114 instead of the bar code, the image capture device 114 of the microwave oven captures an image of the food. As shown in FIG. 3, the controller 202 of the microwave oven determines whether or not the bar code reader 108, which is optionally provided in the microwave oven, can be used (301). When it is determined that the bar code reader 108 cannot be used, the controller 202 captures an image of a package of the food using the image capture device 114 (302), obtains an ID of the food by decoding the image of the package of the food (304), obtains cooking data of the food that corresponds to the ID from the cooking data storage unit 210 (306), and drives the driving unit 212 according to the cooking data so that the food is cooked (308). On the other hand, if the bar code reader 108 is used, the controller 202 obtains cooking data of the food by reading a bar code of the food using the bar code reader 108 (307), and drives the driving unit 212 according to the obtained cooking data so that the food is cooked (308).

When cooking data of food cannot be obtained through a bar code or the user decides to use the image capture device 114 instead of the bar code, the microwave oven with both the bar code reader 108 and the image capture device 114 in accordance with the first embodiment of the present invention, as shown in FIGS. 2 and 3, can identify food by obtaining and decoding the image of the package of the food, and obtain the cooking data of the food so that the food is automatically cooked.

Second Embodiment

Figure 4:
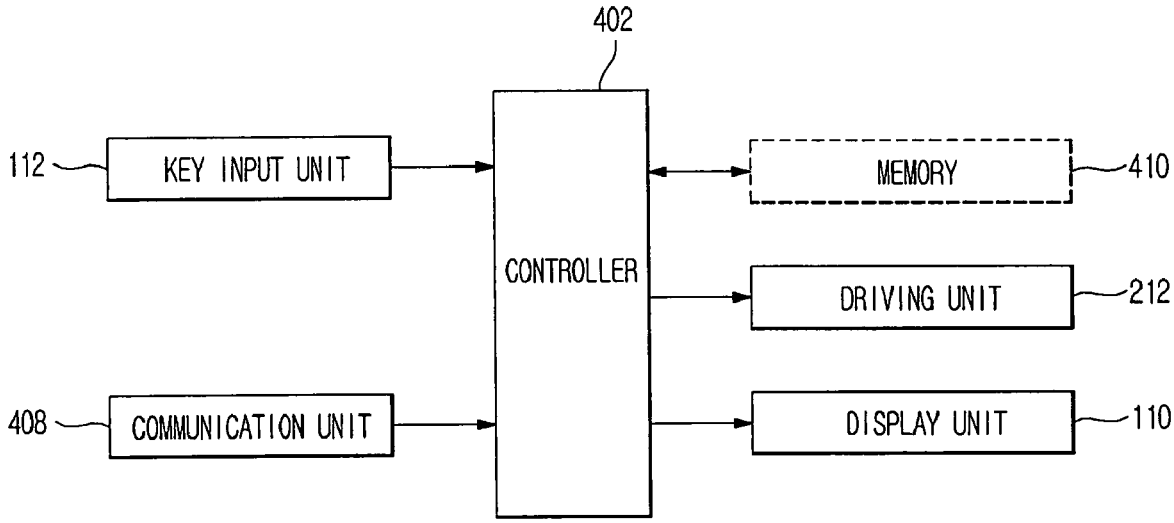
FIG. 4 is a block diagram of a microwave oven of a cooking system in accordance with the second embodiment of the present invention.

FIG. 4 is a block diagram of a microwave oven of a cooking system in accordance with a second embodiment of the present invention. The microwave oven of this embodiment does not include the bar code reader and the image capture device, and includes a communication unit 408 that communicates with external devices. The communication unit 408 communicates with external devices by wire or wirelessly, thereby receiving the cooking data of the food. As shown in FIG. 4, the key input unit 112 and the communication unit 408 are connected to an input side of controller 402. If necessary, the microwave oven may further include a memory 410 for storing the cooking data received by the communication unit 408.

Figure 5:
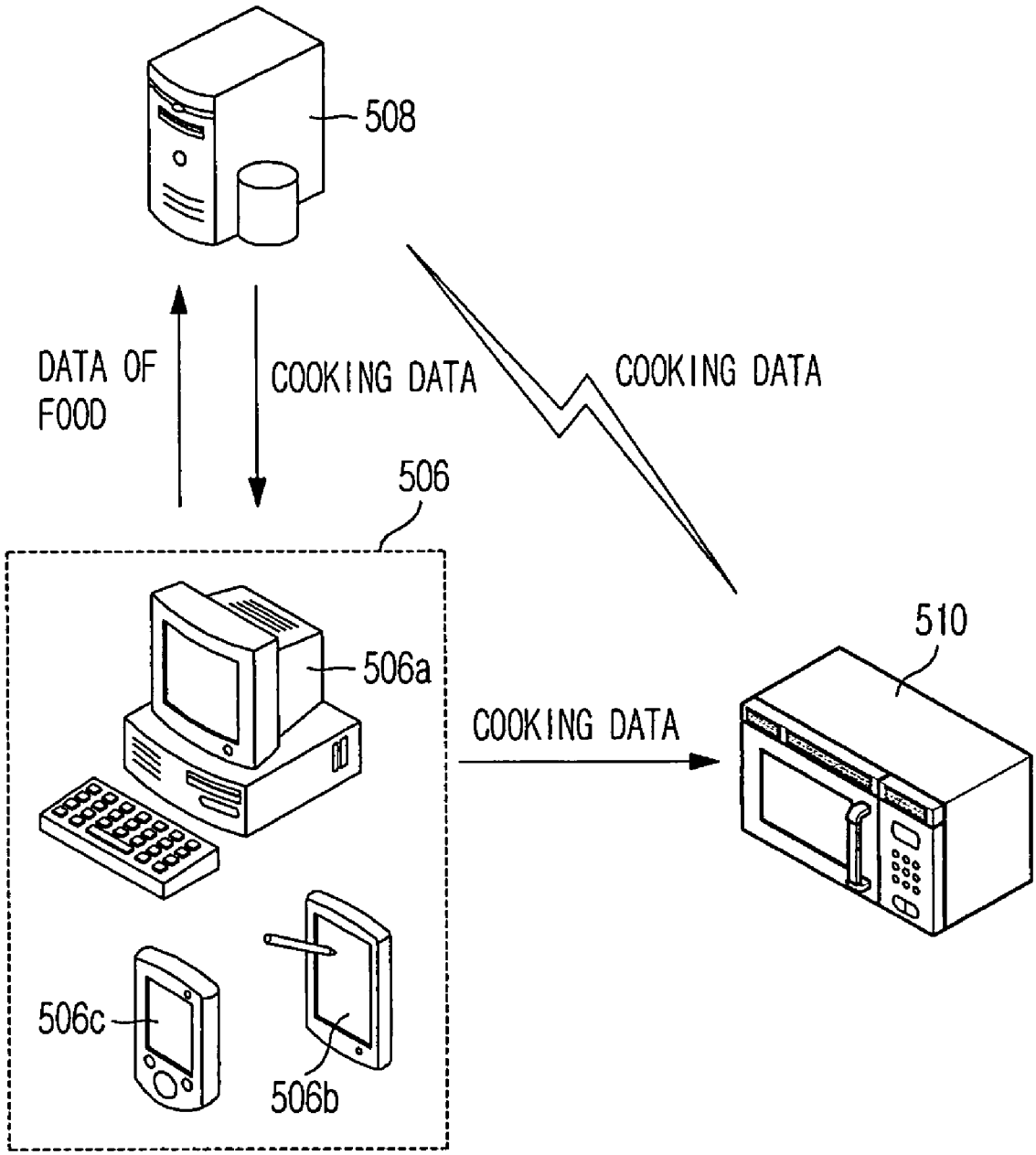
FIG. 5 is a schematic view of the cooking system in accordance with the second embodiment of the present invention, in which food is automatically cooked by obtaining cooking data of the food from a web server and supplying the obtained cooking data to the microwave oven, when the cooking data of the food is not obtained through a bar code.

FIG. 5 is a schematic view of the cooking system in accordance with the second embodiment of the present invention, in which food is automatically cooked by obtaining cooking data of the food from a web server and supplying the cooking data to the microwave oven, when the cooking data of the food is not obtained through a bar code. As shown in FIG. 5, an Internet-based data processing unit 506 searches and obtains cooking data of food, to be cooked, from the web server 508, and transmits the obtained cooking data to a microwave oven 510 by wired or wireless communication so the microwave oven 510 performs the automatic cooking of the food according to the cooking data.

The web server 508 of FIG. 5 is a server of an Internet site, which is operated by a producer of a cooking apparatus (i.e., a microwave oven) or a producer of the food so as to provide the optimum cooking data for cooking specific food using a specific cooking apparatus, or an on-line server. Preferably, the web server 508 provides identification data of the designs of packages of food (i.e., figures or product names printed on the packages) and ID of the foods (for example, identification numbers supplied to products by a producer of food for identifying the products of the food), so that the cooking data of the food is obtained by identifying the food by using one of the images on the package of the food and the identification of the food).

The Internet-based data processing unit 506 is a device, which has a data processing function and a connection to the Internet, for example, an Internet-based personal computer (PC) 506*a*, a web pad 506*b* provided in a refrigerator, or an Internet-enabled personal digital assistant (PDA) 506*c*. The data processing unit 506 may store ID data of the designs of the food packages and ID of the food, identify the food by comparing the image of the food package or the ID of the food, obtain the cooking data of the food, and transmit the obtained cooking data to the microwave oven by wire or wirelessly.

Figure 6:
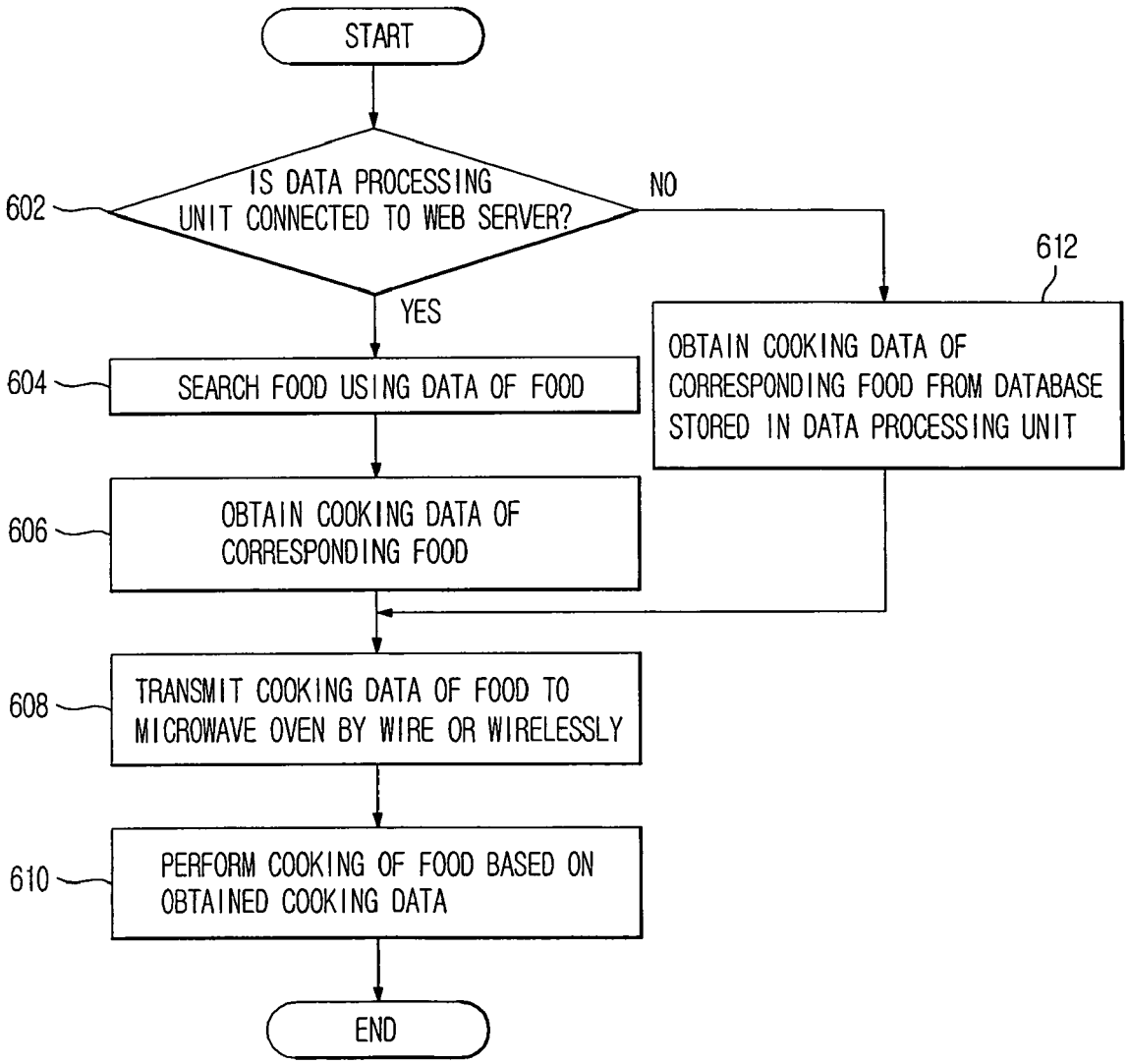
FIG. 6 is a flow chart illustrating a cooking control method of the cooking system shown in FIG. 5.

FIG. 6 is a flow chart illustrating a cooking control method of the cooking system shown in FIG. 5. As shown in FIG. 6, when a user knows fundamental data (for example, name or ID number) of food (i.e., a bar code of which cannot be used or the user decides to use the image capture device 114), the data processing unit 506 is connected to the web server 508 (602), cooking data of the food is searched (604), the cooking data of the food is obtained (606), and the obtained cooking data is transmitted to the microwave oven 510 by wire or wirelessly (608). When the cooking data of the food is transmitted to the microwave oven 510, the cooking data are stored in the memory 410 of the microwave oven 510 and the microwave oven 510 cooks the food according to the stored cooking data (610).

On the other hand, when the data processing unit 506 stores the cooking data of foods therein, it is unnecessary to connect the data processing unit 506 to the web server 508. The cooking data of the food stored in the data processing unit 506 is obtained (612), and the cooking data is transmitted to the microwave oven 510 by wire or wirelessly (608). When the cooking data of the food is transmitted to the microwave oven 510, the microwave oven 510 cooks the food according to the cooking data (610).

In accordance with the second embodiment of the present invention as shown in FIGS. 4 to 6, when the cooking data cannot be obtained using the bar code of the food or the user decides to use the image capture device 114, the cooking data can be obtained by searching the cooking data through the web server 508, or by using the cooking data stored in the data processing unit 506.

Third Embodiment

Figure 7:
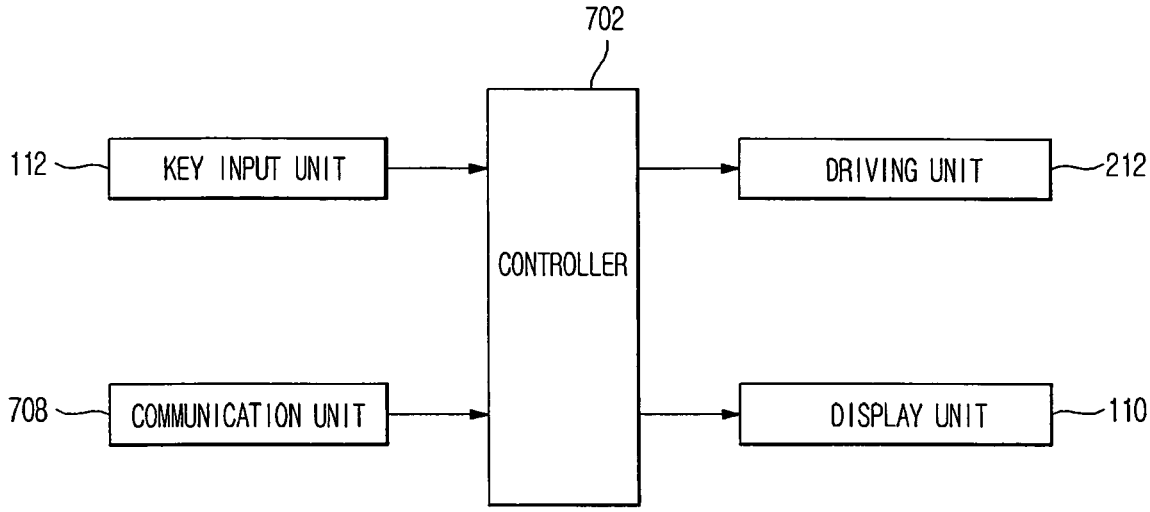
FIG. 7 is a block diagram of a microwave oven of a cooking system in accordance with a third embodiment of the present invention.

FIG. 7 is a block diagram of a microwave oven of a cooking system in accordance with a third embodiment of the present invention. The microwave oven of FIG. 7 does not include an image capture device, but it does include a communication unit 708. The communication unit 708 communicates with external devices by wire or wirelessly, and receives cooking data of food from the external devices.

Figure 8:
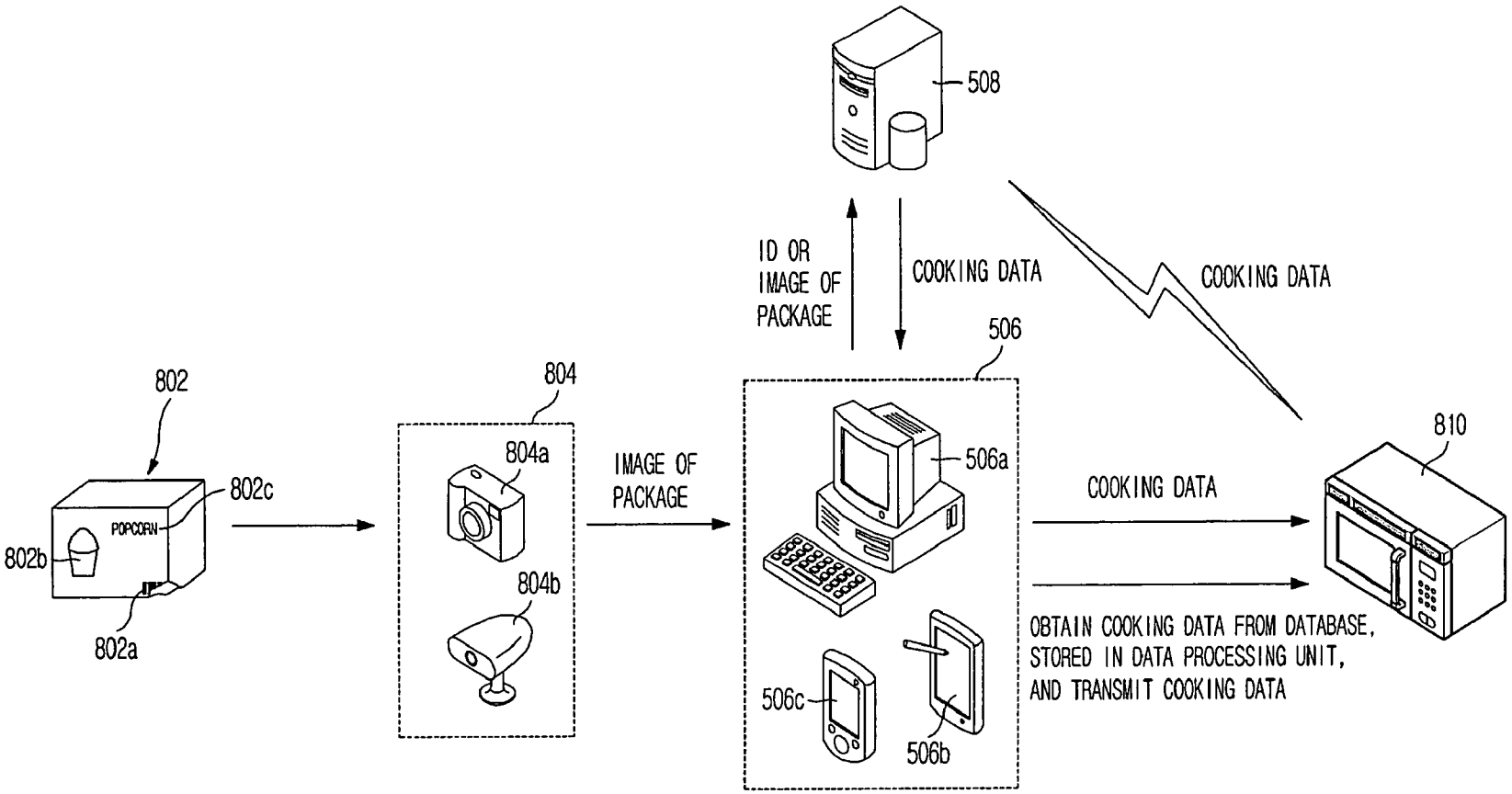
FIG. 8 is a schematic view of the cooking system in accordance with the third embodiment of the present invention, in which food is automatically cooked by capturing an image of the food using a separate image capture device, obtaining cooking data of the food from a web server by decoding the resulting image, and supplying the obtained cooking data to the microwave oven, when the cooking data of the food is not obtained through a bar code.

FIG. 8 is a schematic view of the cooking system in accordance with the third embodiment of the present invention, in which food is automatically cooked by capturing an image of the food using a separate image capture device 504, obtaining cooking data of the food from a web server by decoding the image, and supplying the cooking data to the microwave oven, when the cooking data of the food is not obtained through a bar code. As shown in FIG. 8, a bar code 802*a* is partially torn off from a package 802 of food, and the cooking data of the food cannot be obtained by reading the torn bar code 802*a*.

In this case, a digital image capture device 804 captures an image 802*b* or a name 802*c* of the food, which is printed on the package 802. The digital image capture device 804 includes any device for taking images, such as a digital camera 804*a* or a PC cam 804*b*.

When the image 802*b* or the name 802*c* of the food, which is printed on the package 802, is obtained through the digital image capture device 804, the image 802*b* or the name 802*c* of the food is transmitted to the Internet-based data processing unit 506. The communication between the digital image capture device 804 and the data processing unit 506 is carried out by a device, such as a universal serial bus (USB), IEEE1394, Bluetooth or an infrared communication device. In the case that the data processing unit 506 includes an internal device for capturing an image installed therein, the data processing unit 506 can also capture the image of the food.

The Internet-base data processing unit 506 of the present invention employs an image decoding program executed therein. The image decoding program decodes an image or a name printed on a food package, thus obtaining an ID of the food. That is, since food packages that are sold at a market, have consistent designs, image characteristic data (for example, the shape of the image of a popcorn bag or the word "POPCORN" printed on a package) of designated foods and IDs of products (foods) are stored in the program. The program is executed to decode the image printed on the package and to identify the food, thereby allowing a user to obtain the ID.

Otherwise, the image decoding program is installed in the web server 508 managed by a producer of food to be cooked or a producer of a cooking apparatus. When the Internet-based data processing unit 506 transmits an image that is printed on the food package to the web server 508, the web server 508 decodes the image and transmits the ID of the product (food) to the Internet-based data processing unit 506. The above method is preferred to reduce the load of the data processing unit 506. That is, when the data processing unit 506 is the web pad 506*b* or the PDA 506*c* having low data processing capacity, which cannot execute a high capacity program, this method is more effective. Further, even when the data processing unit 506 is the PC 506*a* having a high capacity microprocessor installed therein, it is possible to omit a process for installing the image decoding program in a user's PC, and the above method is preferred to provide convenience to the user.

In the case when only the printed image on the food package 802 is transmitted to the web server 508, the web server 508 identifies the food that corresponds to the image through the image decoding program, obtains cooking data for the food, and transmits the cooking data to the data processing unit 506.

The data processing unit 506 transmits the cooking data of the food, which was transmitted from the web server 508, to a cooking apparatus 810 and a controller 702 of the cooking apparatus 810 cooks the food based on the cooking data. A home network or a power line carries out the communication between the data processing unit 506 and the microwave oven 810.

Otherwise, the data processing unit 506 receives the ID of the food through the image decoding program executed therein, obtains cooking data of the food that corresponds to the ID (from a database stored therein), and transmits the cooking data to the microwave oven 810 by wire or wirelessly.

Figure 9:
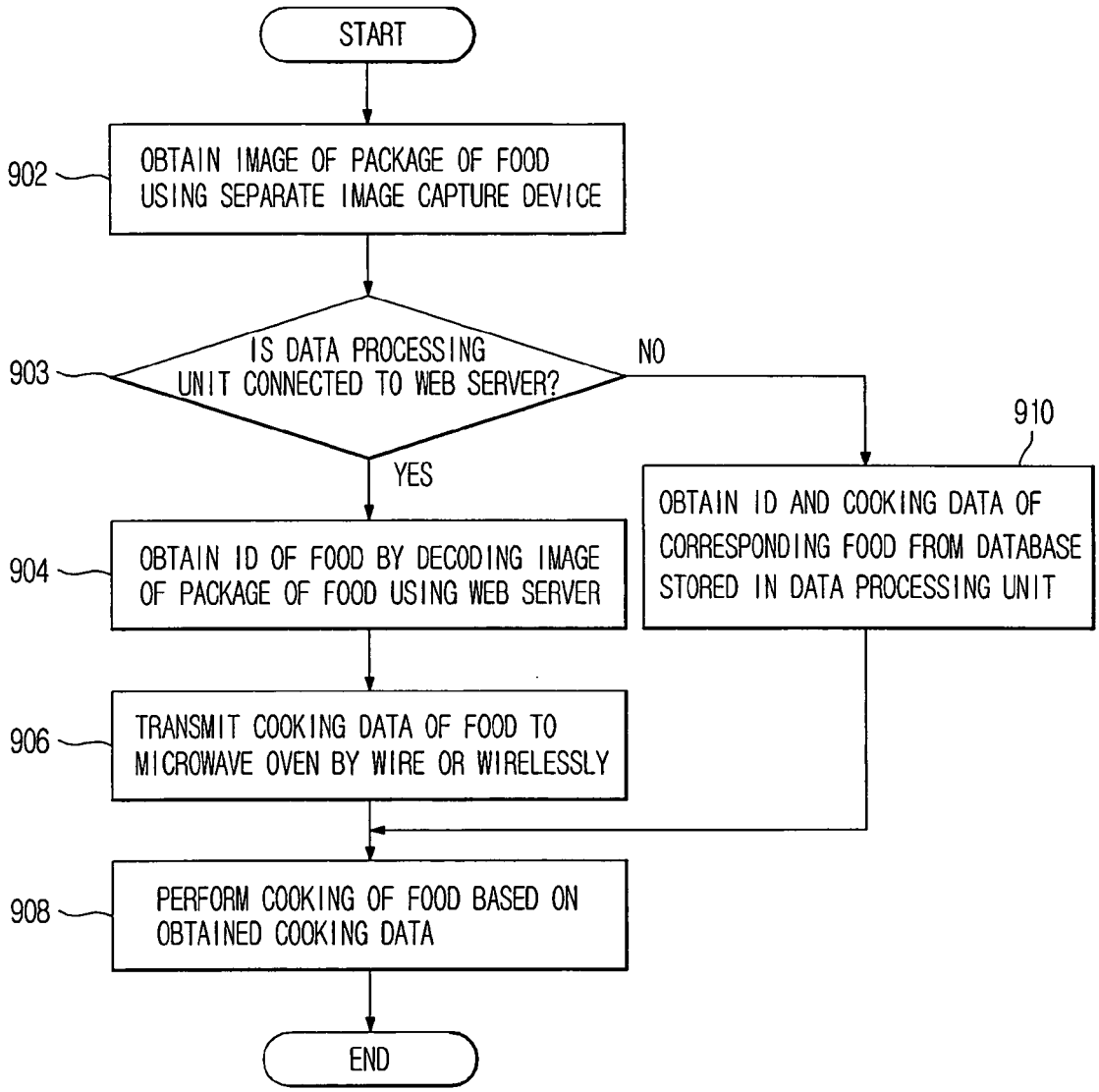
FIG. 9 is a flow chart illustrating a cooking control method of the cooking system shown in FIG. 8.

FIG. 9 is a flow chart illustrating a cooking control method of the cooking system shown in FIG. 8. As shown in FIG. 9, the controller 702 of the microwave oven 810 obtains the image printed on the food package 802 using the separate image capture device 804 (902). It is then determined whether or not the data processing unit 506 is connected to the web server 508 (903). When it is determined that the data processing unit 506 is connected to the web server 508, the web server 508 decodes the food image printed on the food package 802, and obtains the ID of the food (904). When the web server 508 receives the ID of the food by decoding the food image, the web server 508 transmits cooking data of the food to the microwave oven 810 by wire or wirelessly (906). The wired or wireless communication between the web server 508 and the microwave oven 810 may be carried out via the data processing unit 506, or may be directly carried out without the data processing unit 506. When the transmission of the cooking data is completed, the microwave oven 810 cooks the food using the driving unit 212 based on the received cooking data (908).

On the other hand, if the data processing unit 506 contains cooking data for food, it is unnecessary to connect the data processing unit 506 to the web server 508. The data processing unit 506 obtains the ID and the cooking data of the food from a database stored therein (910), and transmits the cooking data to the microwave oven 810 by wire or wirelessly (906). When the cooking data of the food is transmitted to the microwave oven 810, the microwave oven 810 cooks the food using the driving unit 212 based on the received cooking data (908).

In accordance with the third embodiment of the present invention as shown in FIGS. 7 to 9, the cooking data of a food package without a bar code attached or with a damaged bar code is transmitted to the cooking apparatus so that the food is automatically cooked. Accordingly, even when the bar code is damaged or lost, a system, which is used to receive cooking data through a bar code, can perform the automatic cooking of the food.

Fourth Embodiment

Figure 10:
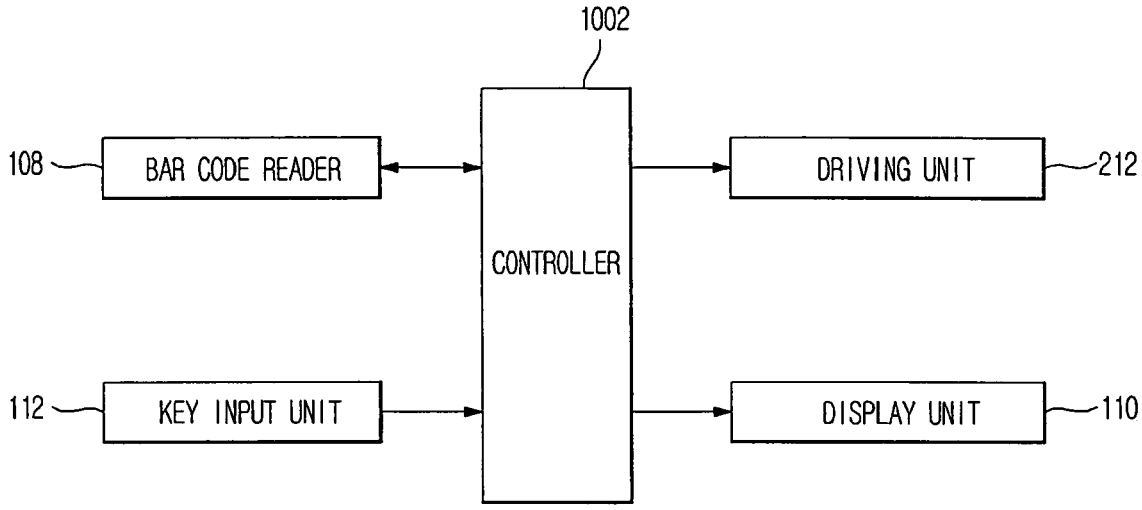
FIG. 10 is a block diagram of a microwave oven of a cooking system in accordance with a fourth embodiment of the present invention.

FIG. 10 is a block diagram of a microwave oven of a cooking system in accordance with a fourth embodiment of the present invention. The microwave oven of FIG. 10 does not include a communication unit, but it does include a conventional bar code reader 108 connected to a controller 1002.

Figure 11:
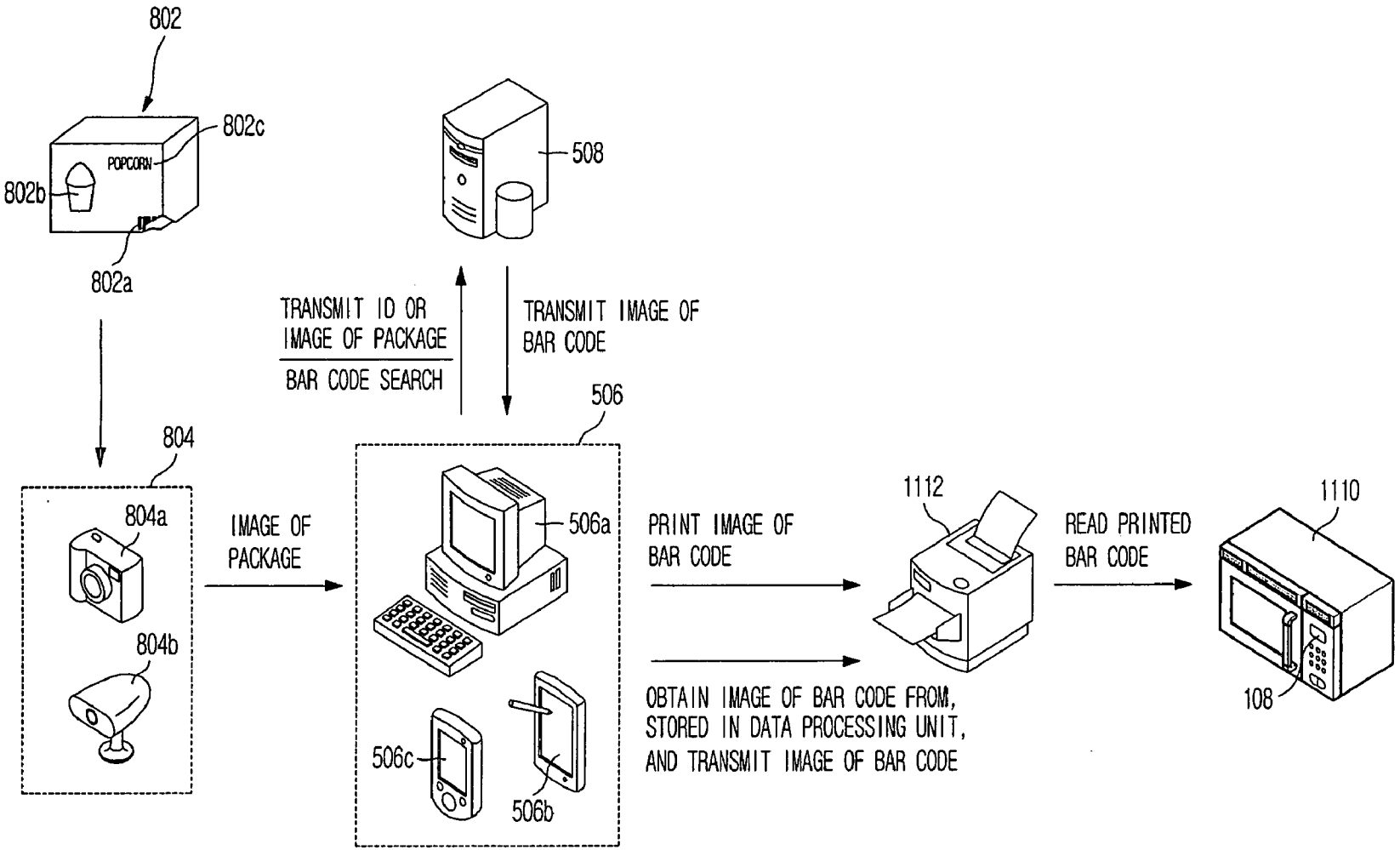
FIG. 11 is a schematic view of the cooking system in accordance with the fourth embodiment of the present invention, in which food is automatically cooked by obtaining an image of the food, when the cooking data of the food is not obtained through a bar code.

FIG. 11 is a schematic view of the cooking system in accordance with the fourth embodiment of the present invention, in which food is automatically cooked by obtaining a food image, when the cooking data of the food is not obtained through a bar code. Here, since a microwave oven 1110 does not include a communication unit, the microwave oven 1110 does not communicate with an external device, and does not receive cooking data transmitted directly from the external device. As shown in FIG. 11, the package 802 is partially torn and the bar code 802*a* is damaged, thus it is difficult to obtain cooking data by reading the bar code 802*a*.

In this case, the digital capture device 804, which is installed separately from the microwave oven 1110, takes an image of food image 802*b* or the food name 802*c* that is printed on the package 802 of the food.

An image of the food 802*b* or the name 802*c* that is printed on the package 802 is captured by the digital capture device 804, and transmitted to the Internet-based data processing unit 806.

In the case when only the food image 802*b* of the package 802 is transmitted to the web server 508, the web server 508 identifies the food that corresponds to the image 802*b* by decoding the image 802*b*, matching the image with the bar code, and transmitting the bar code to the data processing unit 506.

An output unit 1112, such as a printer, outputs the image of the bar code supplied from the web server 508, and the bar code reader 108 of the microwave oven 1110 then reads the output image of the bar code. A controller (1002) of the microwave oven 1110 operates the driving unit (212) so that the food is cooked based on the cooking data.

When the data processing unit 506 is the web pad 506*b* or the PDA 506*c*, it is unnecessary to output the image of the bar code through the output unit 1112, which is installed separately from the web pad 506*b* or the PDA 506*c*. The web pad 506*b* or the PDA 506*c* directly outputs the bar code through a display unit thereof so that the bar code reader 108 can read the output bar code.

Otherwise, the data processing unit 506 obtains the ID of the food through the image decoding program executed therein, obtains the bar code of the food that corresponds to the ID (from a database stored therein), and outputs the image of the bar code of the food through the output unit 1112, such as a printer. Then, the controller 1002 of the microwave oven 1110 operates the driving unit 212 so that the food is cooked based on the cooking data.

Further, in the same manner as the second embodiment of the present invention, the web server 508 may directly search the bar code of the food and output the bar code, and the bar code reader 108 of the microwave oven 1119 may read the bar code.

Figure 12:
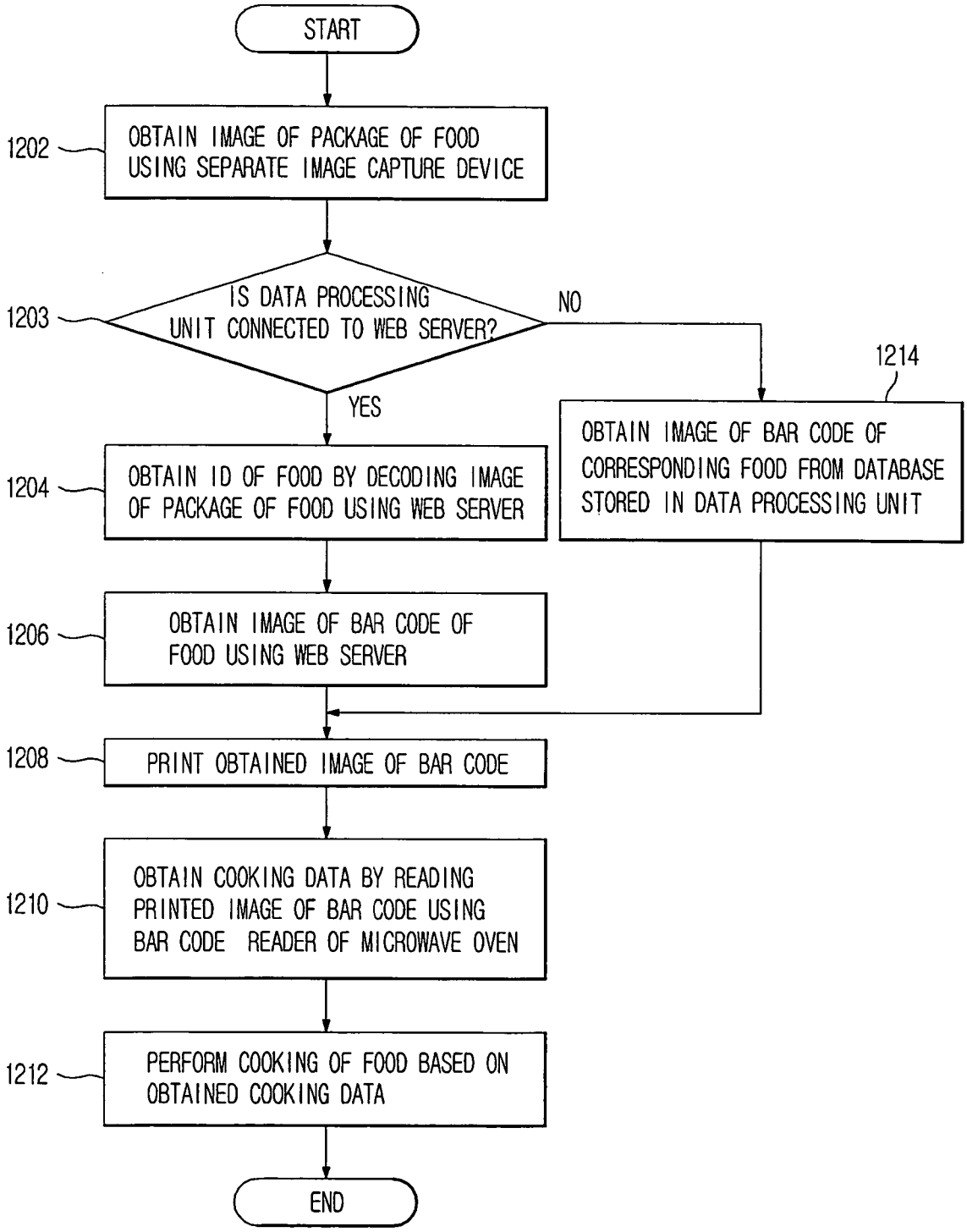
FIG. 12 is a flow chart illustrating a cooking control method of the cooking system shown in FIG. 11.

FIG. 12 is a flow chart illustrating a cooking control method of the cooking system shown in FIG. 11. As shown in FIG. 12, the controller (1002) of the microwave oven 1110 obtains the image of the food package using the image capture device 804, which is installed separately from the microwave oven 1110 (1202). It is determined whether or not the data processing unit 506 is connected to the web server 508 (1203). When it is determined that the data processing unit 506 is connected to the web server 508, the web server 508 decodes the image printed on the package 802 of the food, thus obtaining the ID of the food (1204). When the web server 508 obtains the ID of the food by decoding the image, the web server 508 obtains the image of a bar code of the food, and transmits the image of the bar code to the data processing unit 506 (1206). The image of the bar code transmitted to the data processing unit 506 is output (printed) (1208), and the bar code reader 108 reads the output bar code so that the microwave oven 1110 obtains cooking data of the food (1210). The microwave oven 1110 cooks the food using the driving unit 212 based on the received cooking data (1212).

On the other hand, when the data processing unit 506 contains cooking data of the food so that it is unnecessary to connect the data processing unit 506 to the web server 508, the data processing unit 506 obtains the image of a bar code of the food from a database stored therein (1204). Then, the image of the bar code is transmitted to the data processing unit 506 is output (printed) (1208).

In accordance with the fourth embodiment of the present invention as shown in FIGS. 10 to 12, the cooking data of food without a bar code attached to the package thereof or with a damaged bar code is easily obtained, and are transmitted to the cooking apparatus so that the food is automatically cooked. Accordingly, even when the bar code of food is damaged or lost, a system, which is used to receive the cooking data through a bar code, can perform the automatic cooking of the food.

As apparent from the above description, the present invention provides a cooking apparatus, cooking system, and cooking control method, in which the automatic cooking of food can be appropriately performed by identifying the food by decoding the image printed on a package of the food and receiving cooking data of the identified food from a producer of the food or a producer of the cooking apparatus, when the food does not have a bar code, or has a damaged bar code.

Although embodiments of the invention have been shown and described, it would be appreciated by those skilled in the art that changes may be made in these embodiments without departing from the principles and spirit of the invention, the scope of which is defined in the claims and their equivalents.

What is claimed is:

1. A cooking control method of a cooking apparatus using cooking data, comprising:

obtaining the cooking data of the food by reading a bar code on the food;

obtaining an image of the food using an image capture device if the cooking data cannot be obtained by reading the bar code on the food;

identifying the food by comparing the image of the food to identification data of the food that is stored in a memory of the cooking apparatus, and obtaining the cooking data of the identified food; and controlling the cooking apparatus so that the cooking of the food is performed based on the obtained cooking data.

* * * * *